United States Patent [19]

Ukmar et al.

[11] Patent Number: 4,669,902

[45] Date of Patent: Jun. 2, 1987

[54] MULTITRACK RIBBON CARTRIDGE FOR PRINTING MACHINES

[75] Inventors: Boris Ukmar, Banchette; Mario Trompetto, Mercenasco, both of Italy

[73] Assignee: Ing. C. Olivetti & C., S.p.A., Ivrea, Italy

[21] Appl. No.: 582,738

[22] Filed: Feb. 23, 1984

[30] Foreign Application Priority Data

Mar. 7, 1983 [IT] Italy ..... 67254 A/83

[51] Int. Cl.[4] ..... B41J 32/00

[52] U.S. Cl. ..... 400/208; 400/216.1; 400/228; 400/234; 400/240.4; 400/248

[58] Field of Search ..... 400/194, 195, 196, 196.1, 400/207, 208, 208.1, 216.1, 216.2, 216.3, 216.4, 216.5, 234, 248, 211, 212, 213, 213.1, 217, 217.1, 240, 240.4, 228, 697.1

[56] References Cited

U.S. PATENT DOCUMENTS

| | | | |
|---|---|---|---|
| Re. 31,117 | 1/1983 | Depew | 400/208 |
| 2,747,718 | 5/1956 | May | 400/217.1 X |
| 3,349,888 | 10/1967 | Page | 400/216.1 X |
| 3,613,857 | 10/1971 | Thevis et al. | 400/217.1 |
| 3,830,351 | 8/1974 | Cappotto | 400/196 X |
| 3,882,989 | 5/1975 | Morelli | 400/208 |
| 3,899,065 | 8/1975 | Brignole | 400/248 X |
| 3,900,099 | 8/1975 | Hengelhaupt | 400/248 X |
| 3,927,746 | 12/1975 | Wolowitz | 400/208 |
| 3,960,259 | 6/1976 | Guerrini et al. | 400/208 |
| 4,003,460 | 1/1977 | Gray et al. | 400/248 X |
| 4,091,914 | 5/1978 | Stipanuk | 400/208 X |
| 4,156,573 | 5/1979 | Anderson et al. | 400/196 X |
| 4,172,672 | 10/1979 | Oddicini et al. | 400/214 X |
| 4,203,677 | 5/1980 | Hatsell | 400/212 X |
| 4,268,181 | 5/1981 | Decker | 400/208 |
| 4,280,767 | 7/1981 | Heath | 400/216.2 |
| 4,402,621 | 9/1983 | Abell, Jr. et al. | 400/208 |
| 4,402,622 | 9/1983 | Sugiura | 400/212 |
| 4,425,046 | 1/1984 | Van Horne et al. | 400/208 |
| 4,426,168 | 1/1984 | Jozuka et al. | 400/208 X |
| 4,601,596 | 7/1986 | Musso | 400/697.1 |

FOREIGN PATENT DOCUMENTS

| | | | |
|---|---|---|---|
| 2757993 | 6/1979 | Fed. Rep. of Germany | 400/208 |
| 2930115 | 2/1981 | Fed. Rep. of Germany | 400/208 |
| 0027383 | 3/1981 | Japan | 400/208 |
| 0136384 | 10/1981 | Japan | 400/208 |
| 0144986 | 11/1981 | Japan | 400/213 |
| 0138973 | 8/1982 | Japan | 400/208 |
| 0203084 | 11/1983 | Japan | 400/240.4 |
| 873142 | 7/1961 | United Kingdom | 400/248 |

*Primary Examiner*—Ernest T. Wright, Jr.
*Attorney, Agent, or Firm*—Banner, Birch, McKie & Beckett

[57] ABSTRACT

The ribbon (17) has an external run between the type element (25) and platen of a daisy-wheel typewriter. This run stretches between terminal members (59) which protrude from side arms (33 and 34) of the cartridge casing (18) and are fixed to the distal ends of arms (39, 41) pivotally mounted in the casing (18) at (52). The arms (39, 41) are biased downwardly by wire springs (67) to expose the typing line. Ribbon lift levers of the typewriter raise the arms simultaneously to position a selected one of three tracks on the ribbon at the level of the typing point. The terminal members (59) slide on guides (62) at the ends of the side arms (33, 34), constraining the external ribbon run to lie always within and translate within a single plane. The edges of the guides (62) are curved so that the tilt of the terminal members (59) varies as they move up and down, in such a way as to maintain the ribbon tension uniform across the width of the ribbon (17). The arms (39, 41) are flexible and have pivotal play to permit these constraints on the terminal members (59).

26 Claims, 22 Drawing Figures

MULTITRACK RIBBON CARTRIDGE FOR PRINTING MACHINES

The present invention relates to a ribbon cartridge for typewriters or other printing machines, for example of the character carrying disc (daisy-wheel) type, comprising a typing ribbon having a plurality of transverse tracks which can be selected for the printing operation, a pair of guides between which a section of the ribbon is tensioned, outside the casing, and means which permit transverse displacement of the guides with respect to the casing for selecting one of said tracks. (Transverse means transverse relative to the ribbon).

A ribbon cartridge of this type has been described, wherein a pair of arms guides a section of the ribbon outside the casing. The two arms are pivoted on the casing and oscillate to move the selected track into a position in front of the character carrying disc. In such a cartridge, the angle of inclination of the section of ribbon disposed in front of the point of printing varies considerably during the oscillatory movement of the arms from the position at which the printing or typing is visible to the various track selection heights. In addition, the tensions to which the various transverse sections of the ribbon are subject to change substantially in dependence on the various operating positions of the ribbon. That gives rise to serious disadvantages, in particular when the ribbon is used in machines of the 'daisy-wheel' type in which the space available for the ribbon between the platen roller and the daisy-wheel is very small. It may in fact happen that, on certain occasions, the ribbon suffers from deformation or goes limp, with a substantial deterioration in the quality of printing and the danger of interference between the ribbon and the daisy-wheel, particularly in circumstances involving a plurality of repeated striking cycles.

The object of the present invention is therefore to provide a ribbon cartridge which is simple, and reliable in use, which makes it possible always to have the ribbon correctly tensioned, both in the rest position and in the various operating positions, and which also maintains a constant angle of inclination with respect to the line of printing.

This object is met by the cartridge according to the present invention which is characterised by the characterising portions of the independent claims.

Figure 1:
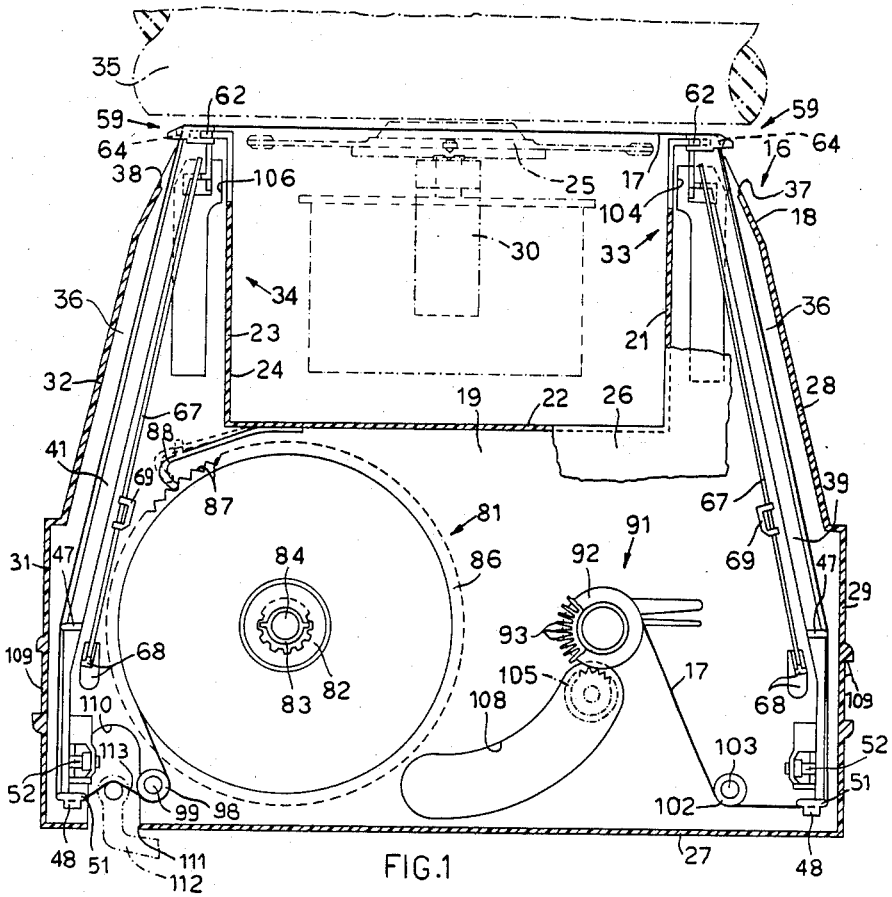
Figure 19:
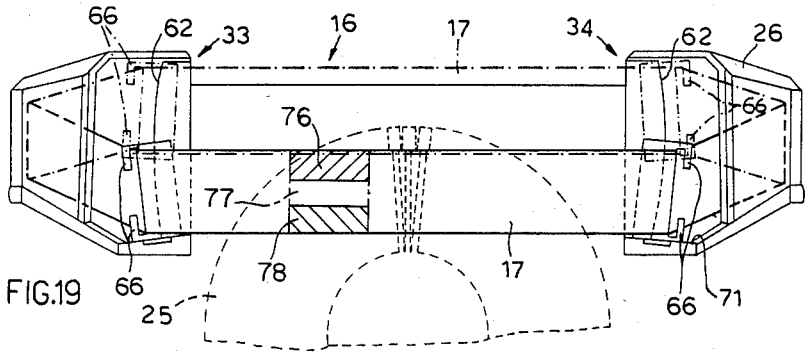
Figure 2:
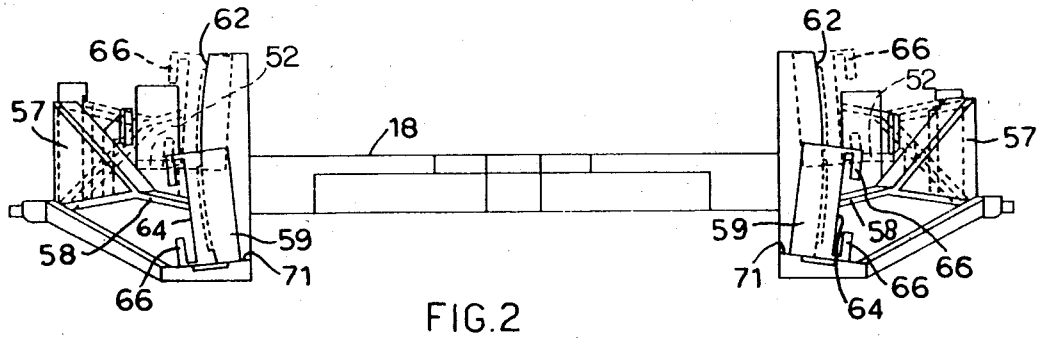
Figure 4:
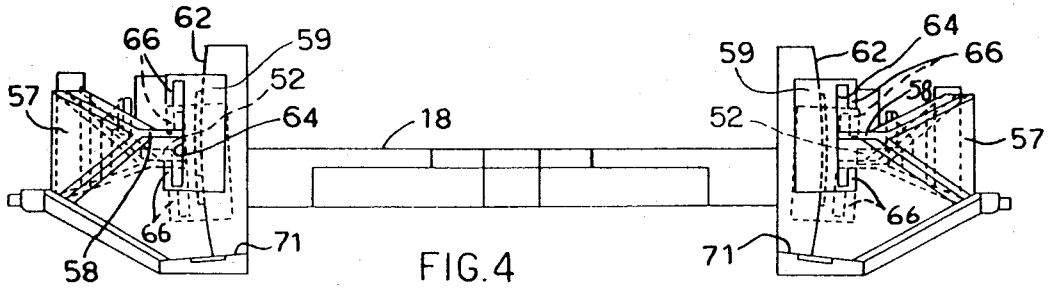
Figure 3:
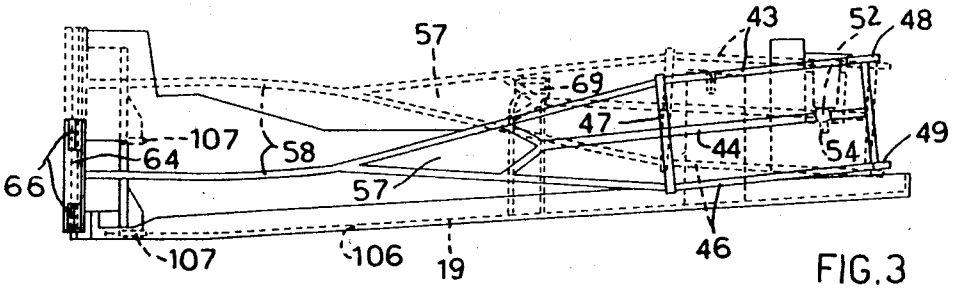
Figure 5:
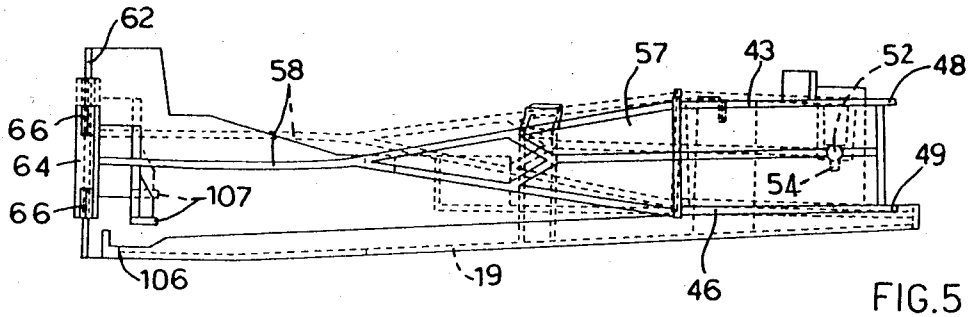
Figure 6:
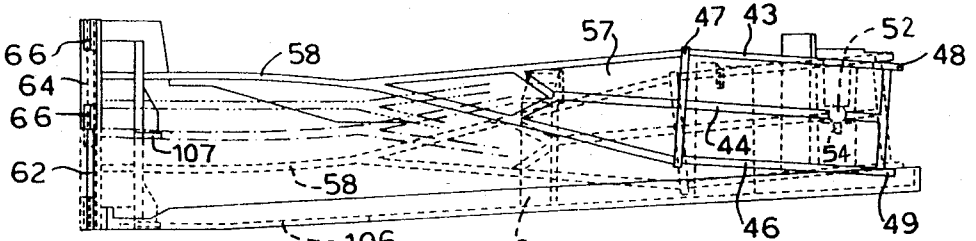
Figure 7:
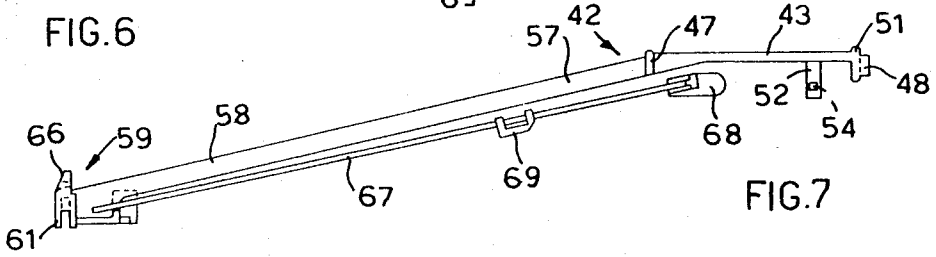
Figure 9:
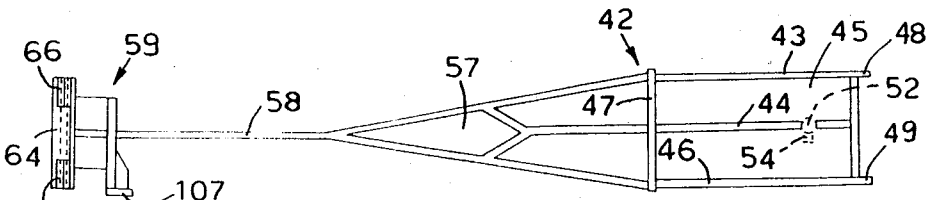
Figure 11:
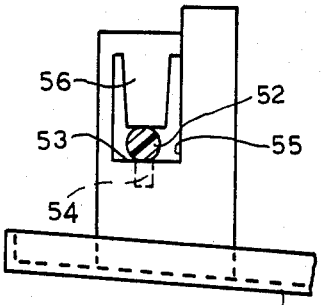
Figure 8:
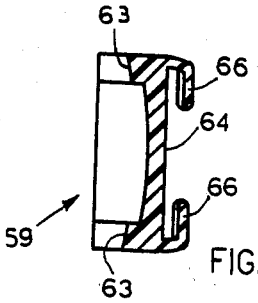
Figure 10:
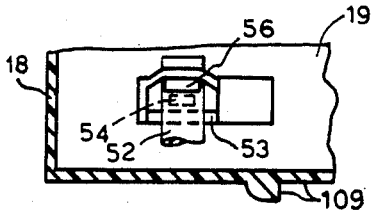
Figure 14:
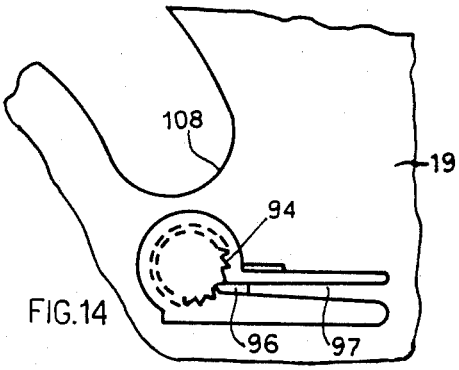
Figure 17:
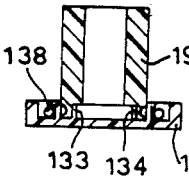
Figure 16:
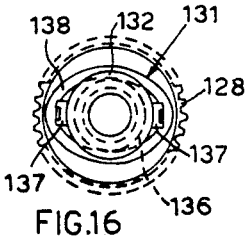
Figure 12:
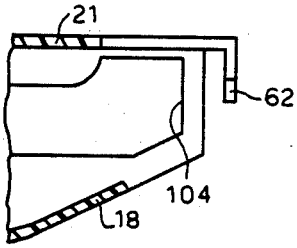
Figure 13:
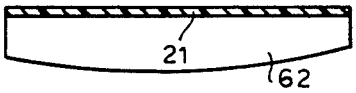
Figure 15:
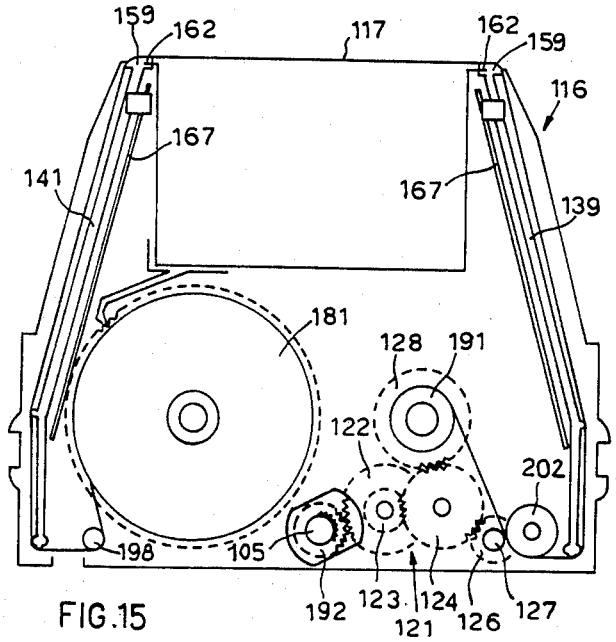
Figure 18:
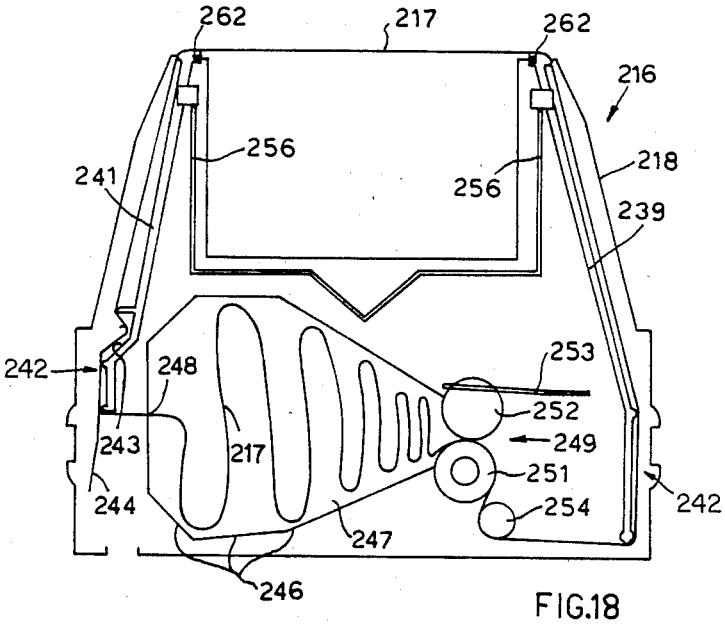
Figure 20:
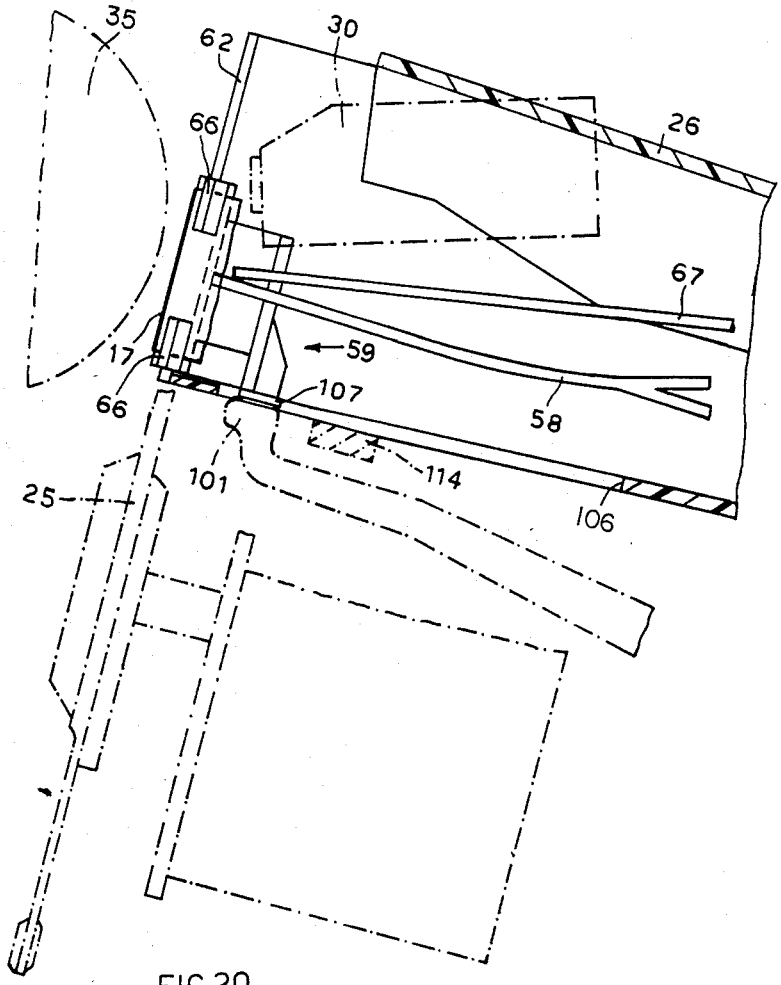
Figure 21:
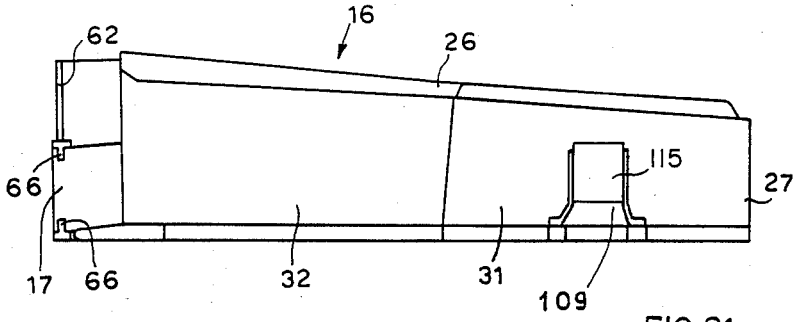
Figure 22:
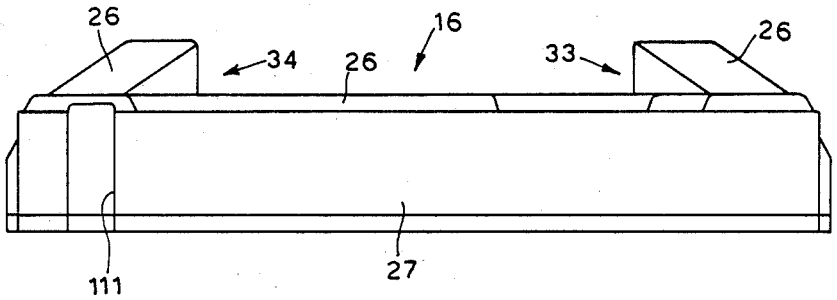

The invention will be described in more detail, by way of example, with reference to the accompanying drawings, in which:

FIG. 1 is a partial plan view of a ribbon cartridge embodying the invention, FIG. 2 is a partial front view of details from FIG. 1 in two operating positions, FIG. 3 is a partial side view of the details shown in FIG. 2 in the two operating positions shown therein, FIG. 4 is a partial front view of details from FIG. 1 in two other operating positions, FIG. 5 is a partial side view of the details shown in FIG. 4, in the two operating positions illustrated therein, FIG. 6 is a partial side view of the details shown in FIGS. 3 and 5 in the four operating positions, FIG. 7 is a partial plan view of details from FIG. 1, FIG. 8 is a partial view in section of details from FIG. 7 on an enlarged scale, FIG. 9 is a partial side view of a detail from FIG. 7, FIG. 10 is a partial plan view of details from FIG. 1 on a larger scale, FIG. 11 is a partial side view of the details shown in FIG. 10, on a larger scale, FIG. 12 is a partial plan view of a detail from FIG. 1, on a larger scale, FIG. 13 is a partial front view of the detail shown in FIG. 12, FIG. 14 is a partial plan view of details from FIG. 1, on a larger scale, FIG. 15 is a diagrammatic view of a first alternative embodiment of the cartridge according to the invention, FIG. 16 is a plan view of details from FIG. 15, on a larger scale, FIG. 17 is a view in section of part of FIG. 16, FIG. 18 is a diagrammatic view of a second alternative embodiment of the cartridge according to the invention, FIG. 19 is a partial front view of the cartridge of FIG. 1, in two operating positions, FIG. 20 is a partial longitudinal view of the cartridge shown in FIG. 1, on a larger scale, FIG. 21 is a diagrammatic side view of the cartridge shown in FIG. 1, and FIG. 22 is a diagrammatic rear view of the cartridge shown in FIG. 1.

In this description "front" and "rear" and related terms refer to the cartridge as mounted on a typewriter (as in FIG. 1) with "front" towards the operator, "rear" away from the operator.

Referring to FIG. 1, a cartridge 16 comprises a casing 18 of plastics material and of substantially parallelepipedic form, for a typing or printing ribbon 17. The casing 18 comprises a bottom portion 19 with rear wall portions 21, 22 and 23 which are arranged to define rearwardly a rectangular opening 24 for housing the upper part of a typing or printing mechanism, for example a character carrying disc 25 (daisy-wheel) and a hammer 30 which are known per se, are disposed in front of and adjacent to a platen roller 35 and shown in chain-dotted lines in the drawings. The platen roller 35 defines a printing point, not shown in the drawing, but substantially similar to the point of typing 12 shown in FIG. 1 of Musso U.S. Pat. No. 4,601,596. The casing 18 is closed upwardly by a cover 26 and is completed by a front wall 27 and side wall portions 28, 29, 31 and 32. The side wall portions 28 and 32 are convergent rearwardly of the cartridge 16 and, together with two projections 36 from the bottom portion 19 and with the rear wall portions 21 and 23, define two side arms 33 and 34 which are closed upwardly by the cover 26. The two arms 33 and 34 are provided at their ends with openings 37 and 38 and accommodate a right-hand ribbon guide arm 39 and a left-hand ribbon guide arm 41.

Each arm 39 and 41 comprises a blade 42 (see FIGS. 7 and 9) provided with a front portion 45 of substantially rectangular shape and a central portion 57 of triangular shape, which is extended rearwardly in a resilient blade 58. The blade 42 is provided with three longitudinal ribs 43, 44 and 46 and a transverse rib 47, the ribs 43, 44, 46 and 47 being provided to reinforce the blade structure. The longitudinal ribs 43 and 46 project with respect to the front edge of the blade 42 and form two limb portions 48 and 49 which are arranged to guide the ribbon 17 transversely when the arms 39 and 41 are mounted in the casing 18. The front edge of the blade 42 comprises a semi-cylindrical projection 51 for supporting the ribon 17. The resilient blade 58 is connected to the ribs 43 and 46 and, at its rearward end, is provided with an arm and ribbon guide element 59.

Each blade 42 is provided at its forward position with a pivot pin 52 which engages in a hole 55 (see FIGS. 10 and 11) in a support 53 of the casing 18 for pivoting the arm 39 and 41 movably with respect to the casing 18. A non-ribbed face of the front portion 45 is guided by the support 53 and a pip 54 prevents the pin 52 from becoming disengaged from the support 53. The hole 55 is limited in an upward direction by a resilient blade 56 which, when assembling the arms 39 and 41 in the casing 18, deflects under the thrust force applied by the end of the pin 52 to permit the pin 52 and its pip 54 to snap past.

The two guide elements 59 (see FIGS. 1, 7, 8 and 9) are of such a configuration as to perform the double function of engaging and guiding the ribbon 17 on the outside of the casing 18 and co-operating with a pair of cams 62 disposed at the ends of the arms 33 and 34 of the casing 18. In particular, the cams 62 have flat front and rear surfaces which are substantially parallel to the wall portion 22 of the casing 18, and a shaped outside edge, see FIGS. 2 and 4. Each element 59 comprises a U-shaped fork or groove 61 in its inner side, the arms of which are arranged to co-operate with the flat surfaces of the cams 62 to prevent longitudinal movements of the arms 39 and 41 and the inside edge 63 of which is engaged and guided by the outside edge of the cam 62 to alter the inclination of the arms 39 and 41 during the oscillatory movements thereof. The guide element 59 further comprises a C-shaped seat portion 64 (FIG. 8) for guiding the ribbon 17 outside the casing 18, holding it engaged between two limbs 66.

On each side of the casing 18, a wire spring 67 is disposed between a fixed support 68 on the casing 18 and the guide element 59 of the respective arm 39, 41. A preloading element 69 which is downwardly offset bends the spring 67 in such a way as normally to hold the respective ribbon guide arms 39, 41 urged downwardly, with a lower end of the element 59 against a shoulder 71 (see FIG. 2) on the casing 18 (see FIG. 1).

Housed in the casing 18 is a feed spool 81, on which the ribbon 17 of the single-use or carbon film type is wound. The spool 81 comprises a core tube 82 with an inner sleeve 83 rotatably mounted on a pin 84 which projects from the bottom portion 19, and a flange 86 which is fixed to the bottom of the sleeve 83. At its outside edge, the flange 86 is provided with a series of peripheral notches 87 adapted to co-operate with a resilient blade 88 mounted on the bottom portion 19 of the casing 18 to prevent casual rotation of the spool 81 and thus uncontrolled unwinding of the ribbon 17.

Also housed in the casing 18 is a take-up spool 91, on which the ribbon 17 is wound after it has been used at the point of printing between the arms 33 and 34. The take-up spool 91 comprises a core tube 92 having at its upper end a series of radial ribs 93 which project from the cover portion 26 and which are capable of being manually engaged for manual rotary movement thereof. On the lower end of the core tube 92 is a series of saw teeth 94 (see FIG. 14) co-operating with a pawl 96 of a resilient blade 97 on the bottom portion 19. The saw teeth 94 are so disposed as to permit rotary movement of the core tube 92 (see FIG. 1) in the direction of winding of the ribbon 17 but co-operate with the pawl 96 (see FIG. 14) to prevent the core tube 92 from rotating in the other direction (see FIG. 1), even when the cartridge 16 is removed from the machine. In the specific case, they permit the core tube 92 to rotate in the anticlockwise direction and prevent it from rotating it in the clockwise direction.

The ribbon 17 which is unwound from the spool 81 is guided around a roller 98 which is mounted rotatably on a pin portion 99 projecting from the bottom 19 of the casing 18, to engage with the semicylindrical projection 51 of the front of the left-hand ribbon guide arm 41, being held by the limb portions 48 and 49. The ribbon 17 then moves parallel to the blade 42 and bears against the transverse rib 47 of the left-hand ribbon guide arm 41 to be guided towards the C-shaped seat portion 64 of the arm 41 and ribbon guide element 59. The ribbon 17 then engages with the C-shaped seat portion 64 of the left-hand ribbon guide arm 41, to be guided parallel to the wall portion 22 until it engages with the C-shaped seat portion 64 of the right-hand ribbon guide arm 39. The ribbon 17 moves parallel to the right-hand guide arm 39 and is guided around the rib 47 of the right-hand ribbon guide arm 39 until it engages the semicylindrical projection 51 and then, guided by the limb portions 48 and 49, it engages with and is guided around a roller 102 mounted rotatably on a pin portion 103 of the bottom 19 of the casing 18, to be wound on to the take-up spool 91.

The casing 18 comprises two openings 104 and 106 which are provided in the bottom of the arms 33 and 34 of the cartridge 16 to permit a lifting arm 101 (see FIG. 20) to pass therethrough. The lifting arm 101 is controlled by a three-lobe cam, not shown in the drawing, already known such as the three-lobe cam 244 shown in FIG. 10 of Oddicini et al U.S. Pat. No. 4,172,672, for simultaneously positioning the right-hand ribbon guide arm 39 and the left-hand ribbon guide arm 41 in three operating positions. The lifting arm 101 is only partially shown and the three-lobe cam cannot be seen in the drawings. These elements are not described herein because they are substantially similar to those described in the U.S. Pat. No. 4,172,672 cited above. Each of the right-hand and left-hand ribbon guide arms 39 and 41 comprises a shoulder 107 which is disposed adjacent to the respective arm and ribbon guide element 59, being capable of co-operating with the lifting arm 101 referred to above, for positioning the respective arms 39 and 41 in one of the three operating positions described hereinbelow.

The casing 18 (see FIG. 1) comprises an aperture 108 in the form of a circular sector disposed adjacent to the take-up spool 91. The aperture 108 is arranged to receive a toothed wheel 105 co-operable with the ribbon 17 which is wound on the take-up spool 91 for winding the ribbon 17 thereon. The provision of a single line of teeth on the toothed wheel 105 ensures that the ribbon 17 is pulled through uniformly and parallel to the axis of the take-up spool 91. The toothed wheel 105 is known per se and is therefore only diagrammatically shown in the drawings.

The bottom portion 19 and the front wall portion 27 of the casing 18 are also provided with an aperture 110 and 111 adjacent to the portion of ribbon 17 between the roller 98 and the projection 51 on the arm 41. The apertures 110 and 111 are arranged to accommodate a lever 112 of the machine. The lever 112 reciprocates to take up slack and controls the unwinding of the ribbon 17 from the spool 81, thus forming a V-shaped loop 113 in the ribbon 17 between the components 98 and 51. That action is combined with that of the resilient blade 88 on the notches 87 and with the movement of the arm 41. One end of the ribbon 17 is fixed to the core tube 82 of the spool 81 and the lever 112 also signals to the machine, complete unwinding of the ribbon 17 from the spool 81 when the tension in the ribbon 17 eliminates the loop 113 formed by the ribbon 17.

The cartridge 16 is removably fixed to a fixed support 114 of the machine in known manner, for example by means of two resilient blade members 115 arranged to engage suitable seat portions 109 of the casing 18. The fixed support is diagrammatically indicated by reference numeral 114 (see FIG. 20), while only one of the resilient blade members 115, which do not constitute subject matter of this patent, is partially shown in FIG. 21.

The typing or printing operation is performed by sequentially using three tracks 76, 77 and 78, as partially schematically represented only on a portion of the ribbon 17 in FIG. 19 in order to simplify the drawing, which are disposed at three different levels on the ribbon 17. In order to simplify the description herein, only the mode of operation of the left-hand ribbon guide arm 41 will be described, being absolutely identical to the mode of operation of the right-hand ribbon guide arm 39. In order further to simplify the following description, solid lines in FIGS. 2 and 3 show the left-hand ribbon guide arm 41 in the viewing position, while broken lines show the left-hand ribbon guide arm 41 in the third operating position or at the third level of the ribbon 17. Solid and broken lines in FIGS. 4 and 5 show the first and second operating positions of the arm 41. FIG. 6 shows all four positions of the left-hand ribbon gude arm 41, the broken line showing the rest position, the dash-dotted line showing the first position or first level, the line comprising three dots and a line showing the second position or second level and the continuous line showing the third position or third level.

FIG. 1 shows that the tension of the ribbon 17 and the force of the wire springs 67 hold the respective ribbon guide arms 39 and 41 in the rest position with the inside edge 63 against the cam 62 and with the lower part of the arms 39 and 41 and ribbon guide elements 59 against the shoulders 71 (see FIG. 2).

In accordance with the invention, the side surfaces of the cams 62 (see FIGS. 2, 3 and 19) define a plane of movement of the elements 59, which is parallel to the plane of rotary movement of the character disc 25 when the cartridge 16 is mounted on the support 114. The arms 39 and 41 can freely follow the movement of the elements 59 by virtue of the longitudinal play between pin portions 52 and the holes 55 in the supports 53 and the flexibility of the blade members 58. The side edge of the cams 62 is of substantially circular section and is followed by the central axis of the elements 59 when they are moved to select one of the three tracks 76, 77 and 78 on the ribbon 17. The distance between the rearward ends of the arms 39 and 41 is altered and compensates for the variation in length of the support means for the ribbon 17, due to the necessarily rectilinear path of movement of the elements 59. Without the compensation effect, the middle section of the ribbon 17 would be limp or would stretch, when the ribbon 17 is raised to select one of the tracks 76, 77 and 78 thereof. The lateral distance between the ends of the arms 39 and 41 (see FIGS. 2 and 4) is at a minimum when the ribbon 17 is in the print viewing position and in the third operating position and is conversely at a maximum when the ribbon 17 is in the first and second operating positions.

When the ribbon 17 is in the first and second operating positions (see FIGS. 1, 4 and 5), the guide elements 59 are substantially vertical and parallel to the projections 51 and to the rollers 98 and 102 and the edges of the ribbon 17 have the same degree of tension as the respective central section. The arms 39 and 41 are of the maximum length compatible with the longitudinal dimensions of the cartridge 16. However, by virtue of the substantial travel of the arms 39 and 41 which is required to achieve a condition of visibility and for selection of the highest track, the edges of the ribbon 17 would tend alternatively to stretch and to go limp, giving rise to the danger of interfering with the 'petals' of the character disc 25 (see FIG. 19). Those disadvantages are overcome by the effect of the cams 62 on the elements 59 which also modify the mutual inclination of the guide 59 of the ribbon 17 in such a way as to maintain a constant tension at the edges and at the central section of the ribbon 17, independently of the track selected.

The tension of the ribbon 17 and that of the wire springs 67 permit the elements 59 to follow the curvature of the cams 62. When the ribbon 17 (see FIGS. 2 and 19) is in the viewing position, the guide edges of the elements 59 converge downwardly. The length of the lower support means of the ribbon 17 is therefore less than that of the upper support means. That compensates for the tendency of the upper edge to go limp and the tendency of the lower edge to become stretched. Conversely, when the ribbon 17 is in the third operating position, the ribbon guide edges of the elements 59 converge upwardly. The length of the upper supports of the ribbon 17 is less than that of the lower support means, thus compensating for the tendency of the upper edge to become stretched and the tendency of the lower edge to go limp.

Referring now to FIGS. 2, 3 and 11, during the operation of lifting the ribbon 17, it will be seen that the left-hand ribbon guide arm 41 pivots with the pin portion 52 on the support 53 of the casing 18 and tends to rotate in the anticlockwise direction. Engagement and guiding of the U-shaped fork 61 by the cam 62 cause twisting and bending of the resilient blade member 58, causing deformation of the left-arm 41, while the arm and ribbon guide element 59 remains rigidly anchored to the cam 62 and holds the ribbon 17 tensioned in its rest position. If now we look at the broken line illustration, it will be seen that the left-hand ribbon guide arm 41, by pivoting on the pin portion 52, tends to rotate in the clockwise direction, but since the U-shaped fork 61 is engaged by the cam 62 and moves in a guided fashion along the cam 62, the resilient blade member 58 bends and twists in the opposite direction to the rest position, while the configuration of the cam 62 is such that the ribbon 17 remains tensioned in the fresh operating position, at the third level, as in the other rest and operating positions.

It will be clear therefore that the combined action of the cam 62 with the bending and twisting of the resilient blade member 58 make it possible to alter the lateral position of the arm 41 and ribbon guide element 59 in response to the transverse movement of the ribbon 17 in such a way as to compensate for the variations in tension and thus accordingly to produce constant tension in the ribbon 17, both at its upper edge and at its lower tensioned edge. In a similar manner as described with reference to FIGS. 2 and 3, it will also be seen from FIGS. 4 and 5 that the combined action of the cam 62, with the bending effect of the resilient blade member 58, alters the lateral position of the arm 41 and ribbon guide element 59 in response to the transverse movement of the arm 41 and ribbon guide element 59 in such a way that the variations in tension are compensated for and they hold the ribbon 17 in a constantly tensioned condition.

It is also clear that the spacing between the pin portions 52 of the arms 39 and 41 and the elements 59 for guiding the ribbon 17 is virtually equal to the maximum longitudinal dimension of the cartridge 16. The curvature associated with the ribbon 17 being moved into the highest raised position thereof is therefore at a minimum, thereby reducing the necessity for corrections in respect of planarity of the ribbon 17.

It will be appreciated that the cartridge 16 for the typing ribbon 17 may be the subject of improvements and modifications, both in regard to the form and the arrangement of the various components and parts without thereby departing from the scope of the invention.

In particular, a first alternative embodiment is provided by use of a multi-use ribbon 17 (see FIG. 15) which can be mounted on a cartridge 116 which is substantially the same as the cartridge 16 shown in FIG. 1 and which is interchangeable therewith on the machine. In fact, the cartridge 116 (see FIG. 15) comprises a feed spool 181, a roller 198, two right-hand and left-hand ribbon guide arms 139 and 141 respectively, two wire springs 167, two cams 162 for guiding the respective arms 139 and 141, a roller 202 and a take-up spool 191, which are substantially the same as the corresponding components of the cartridge 16 (see FIG. 1) described above. Since the multi-use ribbon 117 (see FIG. 15) permits a plurality of characters to be struck on the same portion of ribbon 117, mounted in the lower part of the cartridge 116 is a transmission device of gear type, which is generally denoted by reference numeral 121, for substantially reducing the number of revolutions of the take-up spool 191 with respect to the number of revolutions of the toothed gear 105. The transmission arrangement 121 does not interfere with the ribbon 117 which is wound on to the spool 191 and comprises a drive gear 122 which, when the cartridge 116 is mounted on the machine, is engageable with a pinion 192 disposed below the gear 105. The drive gear 122, by means of a pinion 123, transmits the drive motion to an intermediate gear 124 and from there, by means of a pinion 126, to a pressure roller 127 which presses the ribbon 117 against the roller 202 for incremental advance movement of the ribbon 117. The movement of the take-up spool 191 is produced by means of a friction clutch arrangement 131 (see FIG. 16) and a gear 128 (see FIG. 15) engaged with the gear 124.

In each operating cycle in which the arms 139 and 141 are successively positioned at the first, second and third levels, as described hereinbefore, the combined action of the cams 162 with the bending of the resilient blade members 58 permit changes in the lateral position of the arm and ribbon gude device 159 in response to the transverse movement thereby to compensate for the variations in tension and thus to provide a constant tension in the multi-use ribbon 117, both at its lower edge and at its upper edge.

The clutch arrangement 131 (see FIGS. 15, 16 and 17) permits a reduction in the revolutions of the spool 191 with respect to the gear 128 and winds on to the spool 191 the amount of ribbon 117 which is drawn by the rollers 127 and 202 independently of the amount of ribbon 117 which is already wound on the spool 191. Since movement of the gear 105 is prevented by the gear 122, the central teeth thereof will no longer engage the ribbon 117 which is wound on the spool 191. The take-up spool 191 comprises a tube member 132 having an internal seating or bearing means 133 which is arranged to be guided on a sleeve 134 projecting from the wheel 128. The tube member 132 comprises a circular groove 136 provided in the outside surface of the member 132 and disposed adjacent to the seating means 133. The gear 128 comprises two shoulders 137 which are positioned in diametrically opposite relationship to the sleeve 134 on the gear 128. A rubber ring 138 of circular section, which is commonly known as an O-ring, is mounted between the two shoulders 137 and is housed in the circular groove 136 in the tube member 132 whereby it acts as a brake on the take-up spool 191. If the force for winding the multi-use ribbon 117 on to the take-up spool 191 is lower than a predetermined loading value, the tension of the rubber ring 138 on the tube member 132 is such as to secure the spool 191 with respect to the wheel 128. If the force for winding the multi-use ribbon 117 on to the take-up spool 191 is higher than the above-mentioned predetermined value, the tension of the rubber ring 138 on the tube member 132 is such as to permit a slip motion as between the spool 191 and the gear 128 whereby the spool 191 does not rotate while the gear 128 continues its rotary movement, driven by the intermediate gear 124. In that case, there is a relative rotary movement as between the take-up spool 191 and the gear 128 and the rubber ring 138 behaves substantially like a clutch arrangement.

A second alternative embodiment is provided by virtue of the use of an inked or fabric ribbon 217 (see FIG. 18) which can be mounted on a cartridge 216 that differs slightly from the cartridge 16 shown in FIG. 1, in regard to its internal layout, but which is absolutely the same as regards external configuration and is interchangeable therewith. In the cartridge 216 also, the mode of operation of the right-hand and left-hand ribbon guide arms 239 and 241 and the cams 262 for guiding the respective arms 239 and 241 is substantially the same as in the cartridge 16 described hereinbefore. In fact, the right-hand ribbon guide arm 239 is substantially identical to the right-hand ribbon guide arm 39. The left-hand ribbon guide arm 241 has a blade member 242 which is shorter than the corresponding blade member 242 and the arm 239 and has a recess or cavity 243 for housing a blade spring 244. The spring 244 engages the fabric ribbon 217 and acts as a ribbon tensioning element, the lever 112 of the machine being inactive. Provided in the casing 218 are separator elements 246 which comprise internal wall portions of the casing 218, which define a magazine or storage region 247 in which the fabric ribbon 217 is disposed in coils which are distributed in a random arrangement. The storage region 247 is provided with a slot 248 for the ribbon 217 to issue therefrom. The cartridge 216 is provided with gear means 249 for feeding the ribbon 217 forward in one direction. The gear means 249 comprise a drive gear 251 and an idler gear 252 which is held in contact with the drive gear 251 by a spring 253. A guide roller 254 carries and guides the fabric ribbon 217 towards the gear means 249. A single double-arm spring 256 replaces the wire springs 67 in the cartridge 16, and, by operating in the same manner, provides that the respective arms 239 and 241 are always held in the respective rest positions, as described hereinbefore in relation to the wire springs 67. The higher degree of transverse flexibility of the fabric ribbon 217 and the provision of the ribbon deflection arrangement at 243 render negligible the effects of the greater amounts of deformation of the ribbon 217 as a result of using an arm 241 which is shorter than the arm 239.

We claim:

1. A multitrack ribbon cartridge for a typewriter or other printing machine of the type comprising a platen which defines a printing point, a type-carrier disc, a cartridge support and a lifting mechanism actuatable for lifting a typing ribbon, wherein the typing ribbon has a width including a plurality of adjacent tracks and wherein said ribbon cartridge comprises a casing carrying the typing ribbon and removably mountable on said cartridge support, a pair of oscillatory arms which are pivoted and slidable in the casing and which comprise a pair of terminal members having a corresponding pair of support and guide elements between which an external portion of said typing ribbon stretches externally to the casing to be inserted between the type-carrier disc and the platen, and a pair of flexible portions which are capable of compensating for the straight movement of the pair of terminal members with the movement of the pair of oscillatory arms, said pair of terminal members having means for cooperating with said lifting mechanism, and the combination comprising:

a pair of guide supports carried by said casing for causing said pair of terminal members to be lifted with respect to said casing for the selection of one of said tracks in front of the printing point when the cartridge is mounted on the cartridge support and said lifting mechanism is actuated; and cam elements carried by said pair of guide supports for modifying the relative position between the pair of terminal members in response to the selection movement thereof, in such a manner as to make the tension in each track substantially independent of the selected track.

2. A cartridge according to claim 1, wherein said pair of guide supports cause the external portion of said typing ribbon to follow a substantially straight path which is independent of the selected track.

3. A ribbon cartridge according to claim 2, wherein the pair of guide supports alter the relative inclination of said pair of terminal members.

4. A ribbon cartridge according to claim 1, wherein said pair of terminal members cooperate with said cam elements by means of two parallel faces which are engaged by corresponding U-shaped elements to define a straight path of the external portion of said typing ribbon.

5. A multitrack ribbon cartridge for a typewriter or other printing machines of the type comprising a platen which defines a printing point, a type-carrier disc, a cartridge support and a lifting mechanism actuatable for lifting a typing ribbon, wherein the typing ribbon has a width including a plurality of adjacent tracks and wherein said ribbon cartridge comprises a casing carrying the typing ribbon and removably mountable on said cartridge support, a pair of terminal members having a corresponding pair of support and guide elements between which an external portion of said typing ribbon stretches externally to the casing to be inserted between the type-carrier disc and the platen, said terminal members having means for cooperating with said lifting mechanism, and the combination comprising:

a pair of guide supports carried by said casing for causing said pair of terminal members to be lifted with respect to said casing for the selection of one of said tracks in front of the printing point when the cartridge is mounted on the cartridge support and said lifting mechanism is actuated; and cam elements carried by said guide supports for modifying the relative position of said support and guide elements in response to different lifts of the terminal members;

wherein the external portion of said type ribbon has a given length and wherein the modification of the relative position of said support and guide elements causes the length of some tracks of said plurality of tracks included in said external portion to be modified in such a manner as to make the tension in said some tracks substantially independent of the selected track, wherein said terminal members cooperate with said cam elements by means of two parallel faces which are engaged by corresponding U-shaped elements to define a straight path of the external portion of said typing ribbon, wherein the guide supports alter the relative inclination of the support and guide elements of said terminal members and wherein said cam elements have a shaped edge which cooperates with an inner edge of said U-shaped elements to define the variable inclination of the support and guide elements of said terminal members.

6. A ribbon cartridge according to claim 5, wherein said pair of terminal members are carried by corresponding oscillatory arms pivoted on said casing and wherein said oscillatory arms are flexible and can yield to the torsion forces to compensate for the variations in inclination of the support and guide elements of said pair of terminal members.

7. A ribbon cartridge according to claim 5, wherein the support and guide elements of said pair of terminal members have corresponding support edges for the typing ribbon which converge downwardly in the ribbon position in which printing is visible and converge upwardly in the position in which a lowest track of the typing ribbon is selected.

8. A multitrack ribbon cartridge for a typewriter or other printing machines of the type comprising a platen roller, a type-bearing disc, a cartridge support and a lifting mechanism, wherein said cartridge comprises a typing ribbon having a plurality of tracks which can be selected for the printing operation and a casing for the typing ribbon which can be removably fitted on the cartridge support and which is provided with a pair of side arms projecting rearwardly substantially perpendicular to the platen roller and capable of partially accommodating a portion of the type-bearing disc when the cartridge is fitted on the cartridge support, wherein said casing further includes:

two openings on said pair of side arms;

two guide supports carried by the ends of the pair of side arms adjacent to said ends, respectively;

two oscillatory arms having two flexible portions and two terminal members disposed adjacent to said two flexible portions, wherein said two terminal members are provided with two corresponding ribbon guide elements to stretch an external portion of said typing ribbon outside the casing; and two supports disposed opposite to said pair of side arms;

wherein said two openings cause the access of two vibrating members of the lifting mechanism of the typewriter to cooperating with said two terminal members; and wherein said two oscillatory arms are pivoted on said two supports and said two terminal members are guided movably by said two guide supports of said casing to displace said external portion of the typing ribbon along a substantially straight path included between said portion of the type-bearing disc and the platen roller and which is independent of the selected track upon a lifting of said vibrating members.

9. A ribbon cartridge according to claim 8, wherein said two guide supports and said two terminal members comprise two pairs of surfaces parallel to said straight path and two pairs of shoulder elements, cooperative with said two pairs of surfaces, respectively to define said straight path.

10. A multitrack ribbon cartridge for a typewriter or other printing machines of the type comprising a platen roller, a type-bearing disc, a cartridge support and a lifting mechanism, wherein said cartridge comprises a typing ribbon having a plurality of tracks which can be selected for the printing operation and a casing for the ribbon which can be removably fitted on the cartridge support and which is provided with a pair of side arms projecting rearwardly substantially perpendicularly to the platen roller and capable of partially accommodating a portion of the type-bearing disc when the cartridge is fitted on the cartridge support, wherein said casing further includes:

two openings on said side arms;

two guide supports carried by the ends of the side arms adjacent to said ends, respectively; and two terminal members which are provided with two corresponding ribbon guide elements to stretch an external portion of said typing ribbon outside the casing;

wherein said two openings cause the access of two vibrating members of the lifting mechanism of the typewriter to cooperate with said two terminal members; and wherein said terminal members are guided movably by said two guide supports of said casing to displace said external portion of the typing ribbon along a substantially straight path included between said portion of the type-bearing disc and the platen roller and which is independent of the selected track upon a lifting of said vibrating members, wherein said two guide supports and said two terminal members comprise a curved cam portion and a pair of cam follower portions, further comprising cooperation means for causing said cam follower portions to cooperate with said curved cam portion for inclining said terminal members in response to the movement of said terminal members with respect to said casing in order to make the tension in each track substantially independent of the selected track.

11. A cartridge according to claim 10, wherein said typing ribbon is supported by a pair of fixed guides of the casing far away from the ends of said side arms and wherein said pair of side arms is provided with cover means which permit movement of a portion of the typing ribbon included between said pair of fixed guides of the casing and said support and guide elements and wherein said cover means leave only said terminal members exposed.

12. A ribbon cartridge according to claim 10, wherein the casing is of substantially rectangular section, and includes a front portion provided with two corners opposite to said pair of side arms, further comprising:

a pair of oscillatory arms carrying said two terminal members and which extend within the casing from said two terminal members substantially to said corners; and pivot portions of said casing which pivotally support corresponding pivot means of the pair of oscillatory arms adjacent to said corners at the maximum distance from the external portion of the typing ribbon outside said casing.

13. A cartridge according to claim 12, further comprising fixed guide means fixed on said casing for supporting and guiding the typing ribbon substantially adjacent to said corners from a supply zone and take up zone of said typing ribbon respectively; and oscillatory guide means fixed on said pair of oscillatory arms for supporting and guiding the typing ribbon adjacent to the fixed guide means of the casing of said cartridge.

14. A ribbon cartridge according to claim 12, wherein each oscillating arm has a flexible portion capable of compensating for the straight movement of the two terminal members with the movement of the pair of oscillatory arms.

15. A ribbon cartridge according to claim 12, wherein said casing further comprises slot means on said pivot portions for causing said pivot means of the pair of oscillatory arms to slide with respect to the casing as a consequence of the movement of said two terminal members.

16. A ribbon cartridge according to claim 10, wherein said cooperation means comprise a pair of wire springs having two first ends fixed to said casing and two second ends cooperative with said two terminal members and wherein said pair of wire springs urge said two terminal members to a preferential position.

17. A multitrack ribbon cartridge for a typewriter or other printing machines comprising a typing ribbon having a width including a plurality of tracks, a casing for containing said typing ribbon, two terminal members for stretching an external ribbon run to the external of said casing, connecting means for permanently and movably connecting said two terminal members with said casing of the cartridge, a coupling element on each of said two terminal members for coupling each terminal member with a lifting mechanism of the printing machine for moving the two terminal members with respect to the casing and selecting one of said plurality of tracks on the ribbon for printing, and the improvement comprising:

a pair of first guide means on the casing for constraining the two terminal members to movement along paths such that the external ribbon run of the typing ribbon always lies in and translates in a single plane; and a pair of second guide means for causing the two terminal members to tilt, as said terminal members move with respect to said casing, in such a manner that each one of the plurality of tracks of said external run of the typing ribbon is subject to a tension substantially uniform in all positions of the terminal members with respect to said casing, wherein said pair of first guide means and said two terminal members comprise two pairs of surfaces parallel to said single plane and two pairs of shoulder elements, cooperative with said two pairs of surfaces, respectively, to define said single plane, wherein each one of said two pairs of shoulder elements comprises a U-shaped element of each one of said two terminal members engaging with said pair of surfaces, wherein each one of said pair of second guide means comprise a cam edge, and wherein the U-shaped element of said terminal member comprises an inner edge cooperative with said cam edge for the tilting of said terminal member in response to its movement with respect to said casing.

18. A multitrack ribbon cartridge for a typewriter or other printing machine comprising a typing ribbon having a width including a plurality of tracks, a casing for containing said typing ribbon, two terminal members for stretching an external ribbon run to the external of said casing, connecting means for permanently and movably connecting said two terminal members with said casing of the cartridge, a coupling element on each of said two terminal members for coupling each terminal member with a lifting mechanism of the printing machine for moving the two terminal members with respect to the casing and selecting one of said plurality of tracks on the ribbon for printing, and the improvement comprising:

a pair of first guide means on the casing for constraining the two terminal members to movement along paths such that the external ribbon run of the typing ribbon always lies in and translates in a single plane; and a pair of second guide means for causing the two terminal members to tilt, as said terminal members move with respect to said casing in such a manner that each one of the plurality of tracks of said external run of the typing ribbon is subject to a tension substantially uniform in all positions of the terminal members with respect to said casing, wherein said pair of second guide means and said two terminal members comprise a corresponding pair of curved cam portions and a corresponding pair of cam follower portions, further comprising cooperation means for causing said pair of cam follower portions to cooperate with said pair of curved cam portions for the tilting of said two terminal members in response of the movement of said two terminal members with respect to said casing.

19. A cartridge according to claim 18, wherein said two terminal members are carried by first ends of respective oscillatory arms which have second ends pivoted and slidable in the casing of the cartridge.

20. A ribbon cartridge according to claim 19, wherein each one of the oscillatory arms has a flexible portion intermediate between the first end and the second end, and wherein said flexible portion is capable of compensating for the movement of the terminal members with the movement of the oscillatory arms.

21. A ribbon cartridge according to claim 19, wherein the oscillatory arms extend within said casing and said second ends are pivoted on parts of the casing which are disposed at the maximum distance from the external ribbon run of the typing ribbon.

22. A ribbon cartridge according to claim 18, further comprising spring elements for urging said two terminal members to a preferential position in which the printing point is visible, when the cartridge is mounted on a cartridge support.

23. A ribbon cartridge according to claim 18, wherein said casing is provided with a pair of side arms which are arranged partially to accommodate therebetween a portion of a type-carrier disc, when the cartridge is fitted on a cartridge support of the printing machine, and wherein each one of said pair of first and second guide means is carried by an end of a corresponding side arm.

24. A ribbon cartridge according to claim 18 wherein said two terminal members are carried by an end of a pair of arms which are supported by the casing and oscillate with respect to the casing, and comprise support means for supporting said typing ribbon from a given zone of the casing to a region of one of the arms away from said end, further comprising a bend in said one of the arms adjacent to said region to define a deviation in the path of said ribbon;

guiding means of said one of the arms for guiding the ribbon bodily with the oscillation of said one of the arms; and a spring element which engages the ribbon adjacent to the bend on said deviation, acting as a variable slack take-up means during the advance movement of the ribbon and the oscillatory movement of the arms.

25. A ribbon cartridge according to claim 18, wherein said cooperation means comprise spring means operative on said terminal members for holding in contact said curved cam portions with said pair of cam follower portions.

26. A ribbon cartridge according to claim 25, wherein said spring means comprise a pair of wire springs each having an end fixed to said casing and an opposite end operative with a corresponding terminal member.

* * * * *